United States Patent [19]

Smith

[11] 4,135,320

[45] Jan. 23, 1979

[54] MAGNETICALLY ACTUABLE SAFETY APPARATUS

[76] Inventor: Joseph E. Smith, 170 Locksunart, Apt. 23, Sunnyvale, Calif. 94087

[21] Appl. No.: 781,033

[22] Filed: Mar. 24, 1977

[51] Int. Cl.[2] ..... F41C 17/08

[52] U.S. Cl. ..... 42/70 R; 42/1 MH; 42/66

[58] Field of Search ..... 42/70 R, 70 C, 70 D, 42/70 E, 70 F, 1 MH, 1 LP, 66

[56] References Cited

U.S. PATENT DOCUMENTS

| | | | |
|---|---|---|---|
| 3,978,604 | 9/1976 | Smith | 42/70 E |
| 4,067,132 | 1/1978 | Smith | 42/70 F |

*Primary Examiner*—Charles T. Jordan
*Attorney, Agent, or Firm*—Richard Alan Brown

[57] ABSTRACT

An apparatus for selectively blocking movement of a part of a device employing the apparatus which is particularly useful in preventing the unauthorized firing of a weapon or operation of other touch-actuable devices. The apparatus typically comprises a magnetically actuable member slidably mounted in a housing and magnetic biasing means juxtaposed the magnetically actuable member for maintaining the member in blocking relationship with the part. A magnetic means is provided from without the device for overcoming the attraction or repulsion of the matnetic biasing means, whereby the part is free to move.

37 Claims, 9 Drawing Figures

MAGNETICALLY ACTUABLE SAFETY APPARATUS

BACKGROUND OF THE INVENTION

1. Field of the Invention

The present invention relates to a magnetic apparatus for selectively blocking movement of a part in a device. In particular, the present invention relates to a magnetic apparatus for inhibiting operation of a touch or twist cap-actuable device.

2. Description of the Prior Art

Magnetic devices, per se, are known in the art. Reference is made to U.S. Pat. Nos. 2,548,581; 3,493,902; 3,571,544; 3,801,767; and 3,944,762. The devices taught by these patents generally disclose magnetic safety or switching mechanisms. Also, reference is made to my U.S. Pat. No. 3,978,604 entitled Trigger Inhibiting Mechanism and my pending application Ser. No. 670,937 filed Mar. 26, 1976, now U.S. Pat. No. 4,067,132 entitled Safety Device for Preventing the Unauthorized Firing of a Weapon.

Summary Of The Invention

In accordance with the present invention, an apparatus is provided for selectively blocking the movement of a part of a device employing the apparatus, in which an apparatus has a magnetically actuable member slidably mounted in a housing and magnetic or spring means juxtaposed to the magnetic actuable member for maintaining the member in blocking relationship with the part of a device employing the apparatus.

Further, a magnetic means is provided from without the device for overcoming the biasing forces of the magnetic or spring biasing means, whereby the part is then free to move out of confrontation with the part.

A feature of the present invention resides in the provision of a safety mechanism, simple in construction and reliable in operation, which has exemplary application in inhibiting operation of trigger-actuated mechanisms, other touch operable devices and opening various containers.

A more specific feature of the present invention resides in the provision of a magnetically actuable member that slides into or out of conflicting relationship with a movable part of a device in which the present invention is employed. The magnetically actuable member is positioned in conflicting relationship with the movable part by means of a biasing means, and is moved out of this conflicting relationship by bringing a magnet into close proximity with the magnetically actuable member. If the magnet is subsequently removed from proximity of the magnetically actuable member, the biasing means returns the member to the preferred conflicting relationship with the movable part. In accordance with one embodiment of the present invention, the magnet from without the device employing the present invention is polorized so as to either attract or repel the magnetically actuable member. Preferrably, the magnet employed from without the device is stronger than the biasing means to thereby overcome positioning forces of the biasing means.

A distinct advantage of this invention is the simplicity of construction and reliability of operation. Thus, the apparatus of this invention can be used as a means for inhibiting operation of a trigger-actuated mechanism such as a weapon, a toy pistol or the like, such mechanisms as touch operable pressurized containers or other touch operable mechanisms or the removal of a cap or lid of a container.

DETAILED DESCRIPTION

Figure 1:
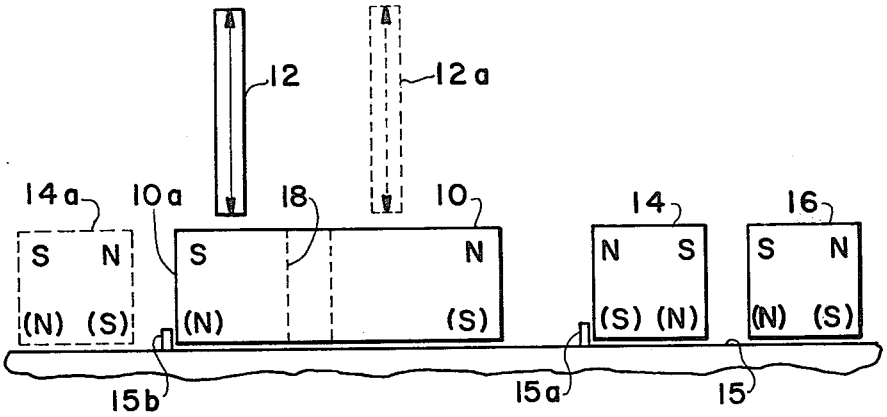
FIG. 1 illustrates the basic principle of operation of the present invention.

Referring now to the drawings, and in particular to FIG. 1, a diagram illustrating the principle of operation of the present invention is shown. A magnetically actuable member 10 is slidably mounted in a housing (not shown), and may be magnetically polarized as illustrated. For example, one end of the member 10 is polarized as a south pole of a magnet and the opposite end thereof is polarized as the north pole. Alternatively, member 10 may be polarized in the opposite direction as illustrated by the letters in parentheses. The member 10 is slidable on a surface 15 which surface has disposed thereon stop means 15*a* and 15*b* to prevent the member from sliding beyond a preferred distance. A movable part 12 of a larger device in which the apparatus of the present invention is employed, moves in a direction as indicated by the overdrawn arrow. As shown in FIG. 1, part 12 is being blocked from movement by the location of the member 10, which member 10 is positioned in this blocking relationship with part 12 by means of a magnetic biasing means 14, that may typically comprise another magnet polarized in a repelling mode with the magnetically actuable member 10. Alternatively, a biasing means 14*a* (shown in phantom) may be located in close proximity to the opposite end of member 10 in an attracting polarization to member 10 in lieu of the bias means 14. Yet other forms of a biasing means, such as a spring or the like, may be used in lieu of a magnet to position the member 10 in a conflicting relationship with the part 12.

A magnetic means 16, which is polarized in a conventional manner, will overcome the magnetic forces of the biasing means 14 (or 14*a* ) when brought into close proximity with the member 10. It is preferrable to have the magnetic means 16 stronger than the biasing means 14 such that when the magnetic means 16 is brought into close proximity with the member 10, the repelling force of the biasing means 14 is overcome, thus allowing the member 10 to slide in the direction of the magnetic means 16. When the member 10 slides toward the magnetic means 16, as depicted in FIG. 1, the part 12 is free to move past end 10*a* of member 10 since this member is no longer in blocking relationship with this part. It is pointed out, however, that member 10 and part 12 need not be at right angles as shown. The function of the blocking relationship can also be effected when member 10 and part 12 are at any oblique, as well as right, angles. If the magnetic means 16 is subsequently removed from proximity with the member 10, the biasing means 14 returns the member to the preferred conflicting relationship with movable part 12. It is noted in other embodiments the magnetically actuable member 10 may be positioned such that, the magnetic forces of means 16 will either repel or attract the member out of the conflicting relationship with the movable part 12.

In accordance with another embodiment of the present invention, member 10 has formed therein a channel 18. In this embodiment, the movable part would be located in a position as illustrated by part **12*a* (shown in dashed lines) in FIG. 1. Accordingly, when the magnetic means 16 is brought into attracting relationship with member 10 such that member 10 slides to the right as shown in FIG. 1, or in a direction towards the magnetic means 16, channel 18 is brought into alignment with the part 12*a*** such that this part is free to move through the channel.

Figure 2:
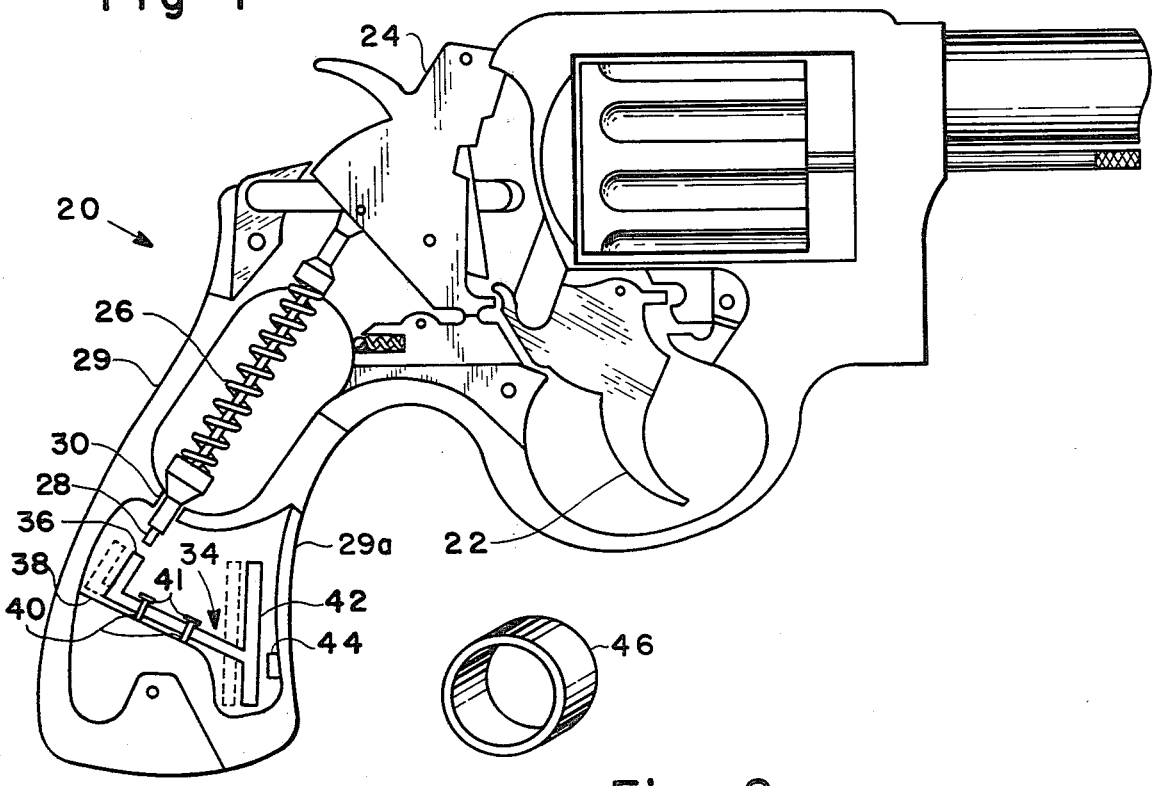
FIG. 2 illustrates a side elevation view of a weapon device employing one embodiment of the present invention.

Referring now to FIG. 2, an example of a specific application of the present invention is illustrated in a firearm 20. Reference is made to my copending application Ser. No. 679,937, filed Mar. 26, 1976, now U.S. Pat. No. 4,067,132, and entitled SAFETY DEVICE FOR PREVENTING THE UNAUTHORIZED FIRING OF A WEAPON for a detailed description of the weapon 20. Briefly, the weapon 20 includes a trigger 22 and a hammer 24 operated by compression spring 26. A shaft or rod 28 within the handle grip frame 29 of the weapon is biased by the spring 26 against the hammer 24 and is slidable in a track 30 directing rod movement approximately along the maximum length of the handle frame 29 in response to hammer rotation. A magnetically actuable member 34 is located in blocking relationship with the shaft or rod 28, which prevents movement of the hammer 24. This arrangement prevents the trigger 22 from displacing the hammer 24 sufficiently to release the hammer.

The member 34 includes a confronting head restrictor 26 disposed in the path of movement of the bar or rod 28 to inhibit movement of the bar or rod sufficiently enough so as to release the hammer 24, thereby inhibiting firing of the weapon. Note, however, that the movable part 28 is not touching the confronting head 36 of the member 34. This arrangement is preferable so as to avoid frictional resistance to movement of the member 34. The member 34 is slidable on a surface 38, and is retained adjacent the surface 38 by means of more than two pins 40, having heads 41 larger than the pins and which also act to guide member 34 along a preferred path. Also, a magnet 42 is attached to one end of the member 34 opposite the restrictor 36. A magnet 44 may be used for biasing the restrictor head 36 of the member 34 in the position of a conflicting relationship with the rod or bar 28. The biasing means 44 may be located near an edge of the handle **29*a* or in any other suitable position so as to maintain member 34 in the preferred conflicting relationship. It is noted that magnet 42** may be formed of any material in the shape of a suitable housing for supporting a permanently magnetized material contained therein.

In operation, the magnetically actuable member 34 is normally biased to a position blocking the translation of the part 28 coupled to the hammer 24, thereby preventing the hammer from substantial rotational movement and spring release. Thus, the hammer neither can be hand-cocked for single-action firing nor trigger-released as in double-action firing. To release the safety device and allow the hammer to release and discharge the firearm, a magnetic means 46 is brought into close proximity with the handle 29 near the edge **29*a* of the weapon 20. The magnetic means 46 can comprise, for example, a ring containing a magnet, which is worn on the finger of the gun-gripping hand by the user of the weapon. Magnetic forces from means 46 cause the magnetically actuable member 34 to slide in a direction away from the magnetic means 44 by magnetic repulsion to thereby move the restrictor head 36 of member 34 out of conflicting relationship and to allow free movement of the part 28. Thus, the trigger may then be fully retracted, or the hammer may be cocked, so that the firearm can be discharged. Accordingly, when a user wearing such a ring grips the handle 29 so as to position such ring in proximity to the edge 29*a* of the handle grip, the weapon may be fired. This latter position is shown in phantom lines in FIG. 2. If the magnetic ring means 46 is subsequently removed from proximity with the member 34, the biasing means 44 will return the member 34** to the preferred conflicting relationship.

Referring now to FIG. **2*a*, a top view of a magnetically actuable member 34*a* is illustrated as an alternative form of the magnetically actuable member 34 employed in the weapon shown in FIG. 2. The magnetically actuable member 34*a* has attached at one end thereof a confronting head restrictor 36*a*, and at the opposite end thereof a magnet 44*a* formed in any suitable shape. Alternatively, magnet 44*a* may be formed from a permanently magnetized material contained within a suitable housing formed to the desired shape. The member 34*a* is retained adjacent to the surface 38 (FIG. 2) by means of the pins 40*a* located in a slot 35 formed longitudinally along the member 34*a* and having edges abutting the pins 40*a*. Heads 41*a* of the pins 40*a* are positioned so as to aid in retaining the member 34*a* adjacent to the slide surface 38 (FIG. 2), while allowing the member 34*a* to be slidable along the surface 38** in response to magnetic attraction or repulsion.

Referring now to FIG. **2*b*, a perspective view is illustrated of a magnetically actuable member 34*b*, which is yet another alternate form of the member 34 employed in the weapon shown in FIG. 2. The magnetically actuable member 34*b* has attached at one end thereof a confronting head restrictor 36*b* and at the opposite end thereof a magnet 44*b*. The member 34*b* is retained adjacent to surface 38*b* by means of a channel or slot 39 having extended lips or ledges 39*a*. The lips or ledges 39*a* are formed to allow member 34*b* to slide in response to magnetic attraction or repulsion without interferring with movement of the restrictor 36*b*. Also, the lips or edges 39*a* preferably are formed so that the member 34*a* is not removable from the channel 39**.

Figure 3:
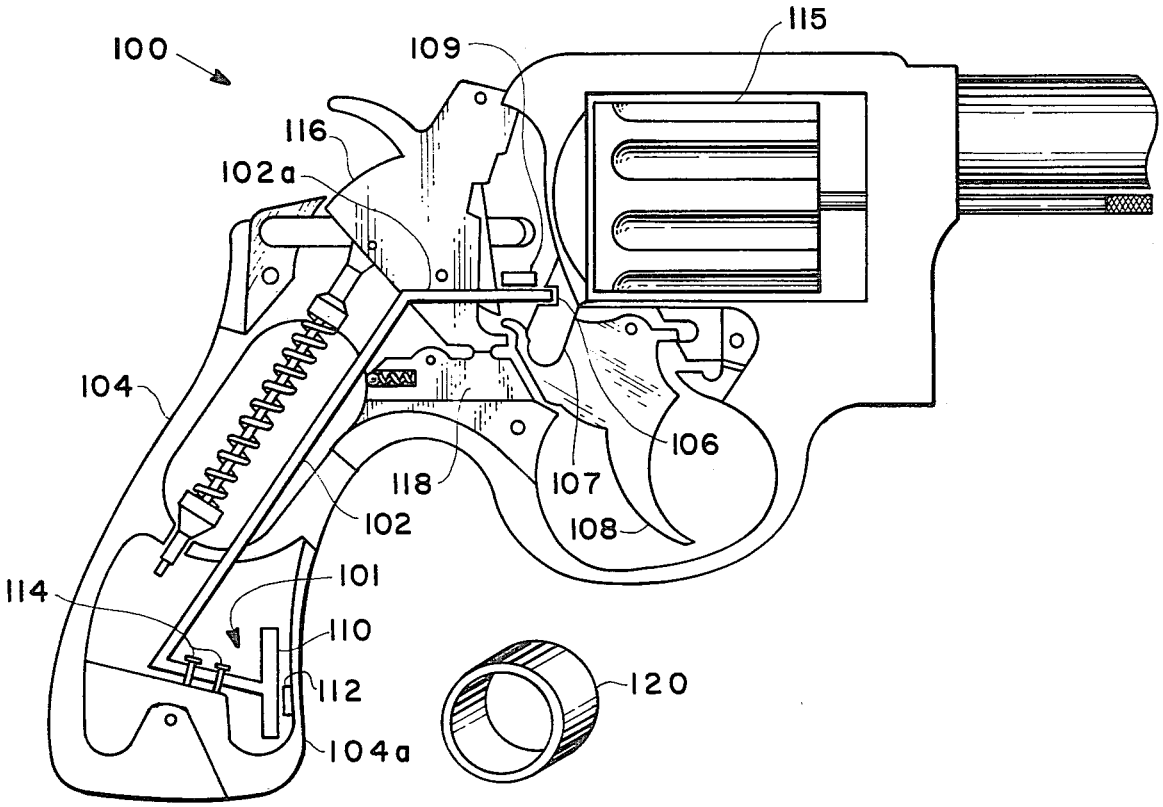
FIG. 3 illustrates another embodiment of the present invention employed in a revolver.

Referring now to FIG. 3, another embodiment of the present invention is illustrated as being incorporated in a revolver 100, wherein a magnetically actuable member 101 has an arm 102 thereof extending through a handle grip frame 104. A restrictor portion **102*a* of the arm 102 is disposed in a conflicting relationship with a notch 106 in a cylinder rotation linkage member 107, which linkage is coupled to trigger 108, for blocking movement of this linkage. A support member 109 is disposed in close proximity to the restrictor portion 102*a* of the arm 102 to reinforce the restrictor portion when engaged in the notch 106 and when the linkage member 107 is moved or attempted to be moved in response to pressure applied to the trigger 108 or attempted movement in response to hand pressure applied directly to the cylinder 115**.

Figure 2A:
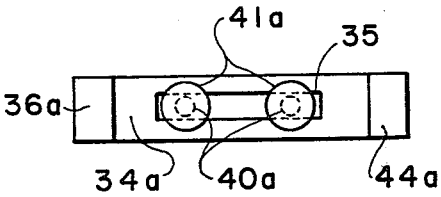
FIGS. 2*a* and 2*b* illustrate alternate forms of the slidable confronting members employed in the weapon shown in FIG. 2.
Figure 2B:
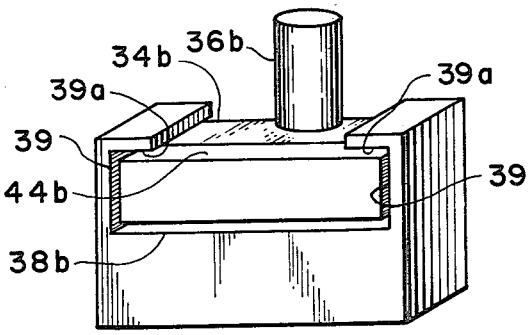

The magnetically actuable member 101 is substantially the same as that described hereinabove with reference to FIG. 2 wherein a magnet 110 is attached to an end of the member 101 opposite to the arm 102. A biasing means 112 may be disposed along an edge of the handle grip frame 104*a* to bias the member 101 in a preferred position. However, it is noted that bias magnet 112 may be located in any suitable position so as to maintain member 101 in the preferred conflicting relationship. The member 101 is slidable along a preferred path and retained by means of pins 114 which engage a slot (See FIG. 2*a*) in the member 101.

In the normal operation, when pressure is applied to the trigger 108, the linkage 107 is moved upward to engage projections (not shown) on an end of cylinder 115 to thereby rotate the cylinder and place the next cartridge in a firing position. Simultaneously, in normal operation, movement of the trigger 108 causes the hammer 116 to rotate in a backward direction thereby cocking the weapon. However, when bias magnet 112, in the embodiment illustrated in FIG. 3, attracts the magnet 110 which positions restrictor portion 102*a* of the arm 102 of the member 101 in the slot 106 of the linkage 107, the linkage member 107 is prevented from moving in response to pressure applied to the trigger 108. Thus, cylinder 115 will not rotate and the hammer 116 will also not rotate in response to pressure applied to the trigger. Accordingly, the weapon employing this invention is not operable by trigger movement so long as the member 101 is maintained in the preferred conflicting relationship.

In accordance with the present invention, when a magnet 120 is brought into close proximity with the edge 104*a* of the handle grip frame 104 the magnet 120 overcomes the biasing forces of the biasing magnet 112 and repels the magnet 110, thereby causing the member 101, including restrictor portion 120*a*, to move out of the notch 106. Thus, the linkage 107 is free to move, as is the hammer 116, in response to pressure applied to the trigger 108 and the weapon can then be fired. If magnet 120 is subsequently removed from proximity with member 101, the biasing means 112 causes the member 101 to return to the preferred conflicting relationship with linkage member 107.

Figure 3A:
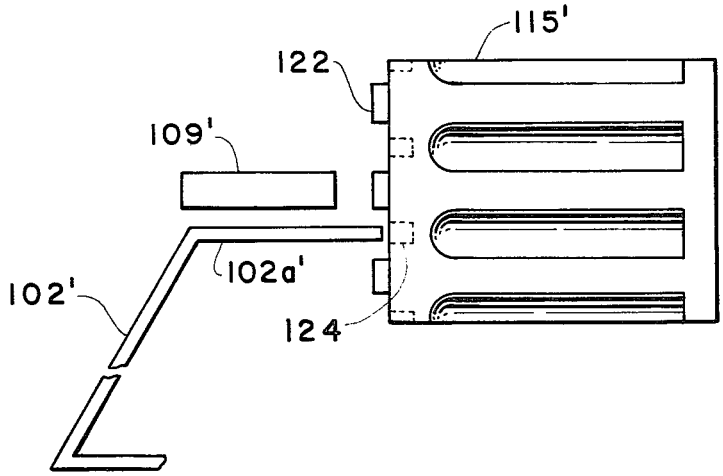
FIG. 3*a* illustrates an alternate form of the embodiment shown in FIG. 3.

Referring now to FIG. 3*a*, another version of the embodiment illustrated in FIG. 3 and described in detail hereinabove is shown. Briefly, a revolver cylinder 115' and a portion of the embodiement of the present invention is shown, since the revolver and the version of this embodiment is substantially similar with that shown in FIG. 3. In this version restrictor portion 102*a'* of the arm 102' is disposed in the path of rotation of projections 122 on an end of the cylinder 115'. Backstop or support member 109 reinforces the restrictor portion 102*a'* when pressure is applied such as from an attempted rotation of the cylinder 115' in response to pressure applied to the cylinder rotation linkage member 107 (FIG. 3) as a function of pressure being applied to the trigger 108 (FIG. 3), which trigger is coupled to the linkage member.

Alternatively, a notch or notches 124 may be formed in an end of the cylinder 115'. The restrictor portion 102*a'* engages within the notch 124 to thereby inhibit movement of the cylinder 115'. The operation of this alternate embodiment is substantially identical to that as described hereinabove.

Figure 4:
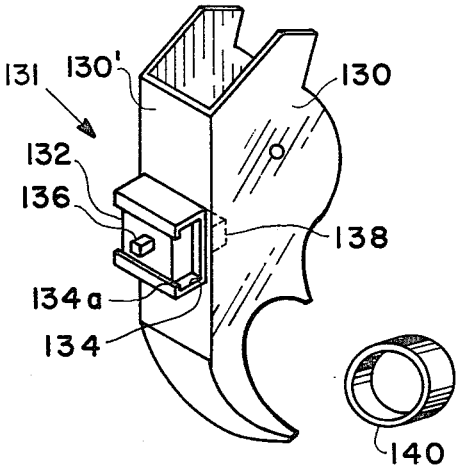
FIG. 4 illustrates yet another embodiment of this invention in the form of a trigger inhibiting mechanism.

Referring now to FIG. 4, yet another embodiment of the present invention is illustrated in the form of a safety apparatus 131 for inhibiting movement of a trigger 130. It is noted that this embodiment of the present invention is illustrated in FIG. 3 of my U.S. Pat. No. 3,978,604 which issued Sept. 7, 1976, and described in detail therein, and is further amplified in my above-cited pending application. Briefly, magnetically actuable member 132 is retained in a channel or slot 134 formed on side 130' of the trigger 130, which side is opposite the side normally touched for firing the weapon. A restrictor head 136 is opposite the side normally touched for firing the weapon. A restrictor head 136 is mounted onto a surface of the magnetically actuable member 132, which restrictor head extends out a sufficient distance so as to conflict with a trigger protector (not shown). A biasing means 138 is shown in a location opposite the surface 130' of the trigger 130 in close proximity to the magnetically actuable member 132 so as to maintain this member, and the restrictor head 136 in particular, in a conflicting relationship with the trigger protector or other suitable backstop of the weapon. However, it is noted that biasing means 138 may be located in any other suitable location so as to maintain the member 132 in the conflicting relationship. The member 132 is free to slide along the channel 134 so as to remove the restrictor head 136 from conflicting relationship with the trigger protector or handle or stock or backstop (none of which are shown) of the weapon. The member 132 preferably slides from side to side within the channel 134, but is retained within the channel by means of lips or ledges 134*a* so that the member 132 is not removable from the channel.

In operation, when the safety apparatus 131 is mounted onto the trigger 130, the restrictor head 136 will confront the trigger protector (not shown). Preferably the trigger and portions of the trigger protector may be formed of a non-magnetic material such as aluminum so as not to interfere with the magnetic forces of the magnetically actuable member 132. Portions of the handle may be notched to allow for the retraction of the trigger 130 without the restrictor head 136 encountering the trigger protector which would allow the weapon to be fired. Conversely, when the restrictor head 136 confronts the non-notched portion of the trigger portion, the trigger cannot be moved sufficiently to fire the weapon.

Also depicted in FIG. 4 is a magnetic ring 140 which may be worn on the trigger finger of the user of the firearm wherein the safety apparatus 131 is provided adjacent to the trigger 130. When the trigger finger is placed on the trigger with the magnetic ring being positioned in close proximity to the trigger, the magnetic ring attracts or repels member 132 out of confronting relationship with the trigger protector. The trigger is then free to be retracted for firing. If the ring 140 is subsequently removed from proximity with the trigger, the biasing means 140 returns the member 132 to the preferred conflicting relationship.

Figure 5:
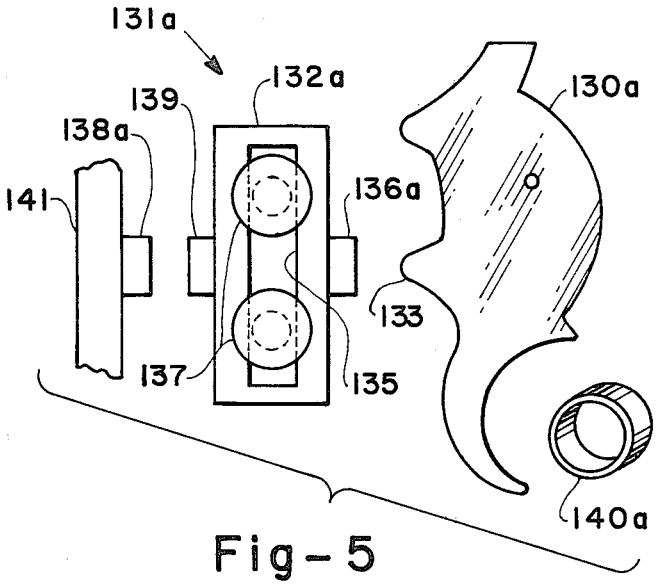
FIG. 5 illustrates yet another form of a trigger inhibiting mechanism.

Referring now to FIG. 5, an alternate form of the embodiment illustrated in FIG. 4 and described hereinabove is shown in the form of a safety apparatus 131*a* for inhibiting movement of trigger 130*a*. A trigger 130*a* is formed with a projection 133 on the side opposite of that normally engaged by the user of the weapon. A magnetically actuable member 132*a* is formed with a slot 135 running longitudinally along the member 132*a*. The member 132*a* is retained in a preferred position and guided along a preferred path by means by pins 137. Thus, in the orientation of this embodiment shown in FIG.5, member 132*a* is free to move up and down when viewing the drawing in a conventional manner.

A restrictor head 136*a* is formed on one side of the member 132*a* in allignment with the projection 133 on the trigger 130*a*. The member 132*a*, and the restrictor head 136*a* in particular, is alligned in a confronting relationship with the trigger 130*a*, and the projection 133 in particular, by means of a biasing means 138*a*.

Normally, the biasing means 138*a* is formed from a permanent magnet, and in which case a second oppositely polarized magnet 139 is formed on the member 132*a* so as to attract this member into a position of a preferred conflicting relationship with the trigger 130*a*. The biasing means 138*a* is shown as being attached to a trigger protector 141 which protector also supports the safety apparatus 131*a* in this embodiment. It is also noted that the safety apparatus 131*a* could be formed as an integral part of the handle or stock of the weapon. Thus, trigger movement. If, however, the member 132*a* is moved either up or down the restrictor head 136*a* is likewise moved, which allows the trigger to move sufficiently to fire the weapon.

When a magnetic ring 140*a*, which is from without and not a part of the weapon or the safety apparatus, is brought into close proximity with the magnetically actuable member 132*a* this member will move. That is, the magnetic forces from the ring 140*a* will move the member 132*a* by either attraction or repulsion, out of the preferred conflicting relationship. Accordingly, the weapon may now be fired. If the ring 140*a* is subsequently removed from proximity with the apparatus 131*a*, the biasing means 138*a* will return the member 132*a* to the preferred conflicting relationship.

It is noted the safety apparatus 131*a* may be oriented so as to permit member 132*a* to move other than up or down, yet comply with the principles of the invention shown in the embodiment of FIG. 5. Further, in any version of this embodiment, projection 133 of trigger 130*a* may be formed from a magnetically attractable material and restrictor head 136*a* formed to contain a magnet. Thus, the restrictor head 136*a* of member 132*a* could be attracted toward projection 133 and this member moved into a position of a preferred conflicting relationship with the trigger 130*a*.

Figure 6:
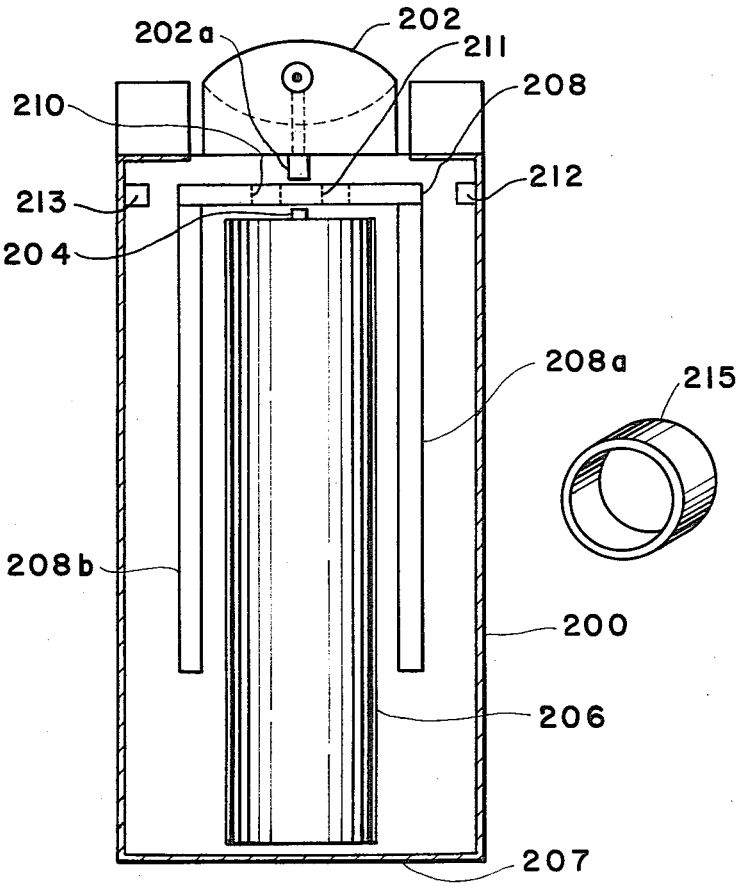
FIG. 6 illustrates the present invention employed in a touch operable pressurized container.

Referring now to FIG. 6, the present invention is illustrated as being employed in a touch-operable pressurized container 200. Container 200 should be constructed of a non-ferrogenous (non-magnetic) material and, for example, may comprise any of the familiar pressurized containers such as a tear gas or similar type propellant can. The contents of the pressurized tank 206 are released therefrom by applying pressure to a button 202. The button 202, when pressed, engages a nozzle 204 of the retaining tank 206, thereby allowing the vaporized pressure or liquid to escape from the tank 206.

In accordance with the embodiment of the present invention illustrated in FIG. 6, a magnetically actuable member 208 is disposed between the button 202 and the nozzle 204. The member 208 has openings 210 and 211 formed therein, the diameters of which are sufficient to allow passage of the portion 202*a* of the button 202. Any number of openings, such as openings 210 and 211, may be employed. Biasing means 212 and 213, which may be magnets, are formed adjacent the perimeter of the container 200 to position the magnetically actuable member 208 in conflicting relationship with the button 202 to thereby prevent the portion 202*a* of this button from engaging the nozzle 204.

If, for example, a magnet 215 is brought into close proximity with the container 200, and preferably within close proximity to the member 208, such member will move either away from or toward the magnet (depending upon the polarizations thereof) thereby aligning openings 210 and 211 with the portion 202*a* of the button 202 which will allow engagement of the portion 202*a* with the nozzle 204. Accordingly, pressure applied to button 202 will discharge propellent contained within the tank 206. If the magnetic means 215 is subsequently removed from proximity with the container 200, the bias means 212 and 213 will cause the member 208 to return to the preferred conflicting relationship after the nozzle is released.

In accordance with a peferred embodiment, member 208 includes magnetically actuable extension portions 208*a* and 208*b* or only a portion thereof which extend substantially parallel with the longitudinal axis of the container 200. The magnetically actuable extensions 208*a* and 208*b* may also form the walls of a cylinder having a diameter between that of the container 200 and the tank 206, and the member 208 being formed in a disc-shaped pattern capping the cylinder. When a magnet 215 is brought into close proximity with the edge of the container 200, the member 208 slides either toward or away from the magnet so as to allign opening 210 or 211 with the portion 202*a* of the button 202 to thereby allow this portion to engage the nozzle 204. By forming the member 208 in the shape of a cylinder disposing coaxially with the container 200, the magnet 215 may be placed in close proximity with any portion of the sides of the container 200 to thereby move the member 208 out of conflicting relationship between the portion 202*a* and the nozzle 204.

It is noted, the container 200 and the magnetical actuable member 208 will be the most expensive portion of this embodiment. Therefore, a removable cap or the like could form the button 207 of the container 200 thereby to allow the tank 206 to be removed for repressurization or to be replaced with another such tank.

The foregoing provides a simple device which acts as a safety device in the use of firearms or other touch operable devices. It is particularly useful to prevent unauthorized or accidental discharge of the firearm and operable devices. Also, the subject invention eliminates the time required to remove the safety on a weapon so the officer may act more rapidly. Additionally, unauthorized operation is prevented for touch operable devices such as pressurized containers, power tools, or the like, thereby reducing accidental injuries to children and adults.

The foregoing is considered to have shown and described preferred embodiments of this invention, it being understood that numerous modifications and changes in details of construction, combination, and arrangement can be resorted to by those skilled in the art without departing from the scope of the invention as defined in the appended claims. It is noted other embodiments include, but are not limited to, inhibiting triggers on power tools, inhibiting removal of caps of bottles, inhibiting opening lids of containers, inhibiting operation of switches and the like.

What is claimed is:

1. A safety apparatus for selectively blocking movement of a part of a weapon employing said apparatus comprising:

a magnetically actuable member slidably mounted with respect to said part;

stop means for preventing said member from sliding beyond a preferred distance;

biasing means juxtaposed said magnetically actuable member for maintaining said member in a blocking relationship with movement of said part; and magnetic means from without said weapon for overcoming said biasing means, so as to slide said member out of the blocking relationship with said part so that said part is free to move.

2. An apparatus as in claim 1 further characterized by said magnetic means being formed in the shape of a ring to be worn by the user of said weapon.

3. An apparatus as in claim 1 further characterized by said biasing means comprising a magnetic means oriented in a repelling polarization with and juxtaposed to said magnetically actuable member for repelling said member into blocking relationship with said part.

4. An apparatus as in claim 1 further characterized by said biasing means comprising a magnetic means oriented in an attracting polarization with and juxtaposed to said magnetically actuable member for attracting said member into blocking relationship with said part.

5. A safety apparatus for preventing unauthorized firing of a weapon having a trigger, a hammer, and a hammer movement means operational in response to trigger movement, comprising:

a magnetically actuable member slideably mounted with respect to said hammer movement means, said member having at least one magnetically polarized end;

stop means for preventing said member from sliding beyond a preferred distance;

bias means juxtaposed said magnetically actuable member for maintaining said member in a blocking relationship with said hammer movement means for preventing the movement of said hammer movement means firing said weapon; and a magnetic ring for wearing on a finger of a hand gripping said weapon, said ring being operative on said polarized end for overcoming said bias means, so as to slide said member out of the blocking relationship with said hammer movement means when said ring is being worn on a finger of the weapon gripping hand.

6. An apparatus as in claim 5 further characterized by said magnetic ring being operative to repel said polarized end.

7. An apparatus as in claim 6 further characterized by said bias means comprising a magnetic means oriented in an attracting polarization with and juxtaposed to said magnetically actuable member for attracting said member into blocking relationship with said hammer movement means.

8. An apparatus as in claim 7 further characterized by said hammer movement means including a shaft coupled to a hammer.

9. An apparatus as in claim 7 further characterized by said magnetically actuable member having a restrictor for blocking movement of said hammer movement means and said restrictor being responsive to movement of said member.

10. An apparatus as in claim 6 further characterized by said bias means comprising a magnetic means oriented in repelling polarization with and juxtaposed to said magnetically actuable member for repelling said member into blocking relationship with said hammer movement means.

11. An apparatus as in claim 10 further characterized by said hammer movement means including a shaft coupled to a hammer.

12. An apparatus as in claim 10 further characterized by said magnetically actuable member having a restrictor for blocking movement of said hammer movement means and said restrictor being responsive to movement of said member.

13. An apparatus as in claim 5 further characterized by said magnetic ring being operative to attract said polarized end.

14. An apparatus as in claim 13 further characterized by said bias means comprising a magnetic means oriented in an attracting polarization with and juxtaposed to said magnetically actuable member for attracting said member into blocking relationship with said hammer movement means.

15. An apparatus as in claim 14 further characterized by said hammer movement means including a shaft coupled to a hammer.

16. An apparatus as in claim 14 further characterized by said magnetically actuable member having a restrictor for blocking movement of said hammer movement means and said restrictor being responsive to movement of said member.

17. An apparatus as in claim 13 further characterized by said bias means comprising a magnetic means oriented in repelling polarization with an juxtaposed to said magnetically actuable member for repelling said member into blocking relationship with said hammer movement means.

18. An apparatus as in claim 17 further characterized by said hammer movement means including a shaft coupled to a hammer.

19. An apparatus as in claim 17 further characterized by said magnetically actuable member having a restrictor for blocking movement of said hammer movement means and said restrictor being responsive to movement of said member.

20. In a safety apparatus for preventing the unauthorized firing of a weapon having a trigger, a cylinder for holding cartridges to be fired by said weapon, a cylinder rotation means operative in response to movement of said trigger, a hammer, and a hammer movement means operative in response to movement of said trigger, comprising:

a magnetic actuable member slideably mounted with respect to said cylinder rotation means, said member having at least one magnetically polarized end;

stop means for preventing said member from sliding beyond a preferred distance;

bias means juxtaposed said magnetically actuable member for maintaining said member in a blocking relationship with said cylinder rotation means for preventing the movement of said cylinder rotation means for preventing rotation of said cylinder thereby preventing firing of said weapon; and a magnetic ring for wearing on a finger of a hand gripping said weapon, said ring being operative on said polarized end for overcoming said bias means, so as to slide said member out of the blocking relationship with said cylinder rotation means when said ring is being worn on a finger of the weapon gripping hand.

21. An apparatus as in claim 20 further characterized by said magnetic ring being operative to repel said polarized end.

22. An apparatus as in claim 21 further characterized by said bias means comprising a magnetic means oriented in an attracting polarization with and juxtaposed to said magnetically actuable member for attracting said member into blocking relationship with said cylinder rotation means.

23. An apparatus as in claim 21 further characterized by said bias means comprising a magnetic means oriented in a repelling polarization with and juxtaposed to said magnetically actuable member for repelling said member into blocking relationship with said cylinder rotation means.

24. A safety apparatus as in claim 21 further characterized by said cylinder rotation means comprising a linkage mechanically coupled between said trigger and said cylinder and said linkage having a notch formed therein and said magnetically actuable member having an extension thereof for engaging said notch.

25. A safety apparatus as in claim 21 further characterized by said cylinder having a plurality of projections on one end thereof, and said projections forming a portion of said cylinder rotation means, and said magnetically actuable member being slideably disposed for interfering with said projections.

26. An apparatus as in claim 25 further characterized by said bias means comprising a magnetic means oriented in a repelling polarization with and juxtaposed to said magnetically actuable member for repelling said member into a position for engaging said notches.

27. An apparatus as in claim 20 further characterized by said magnetic ring being operative to attract said polarized end.

28. An aparatus as in claim 27 further characterized by said bias means comprising a magnetic means oriented in an attracting polarization with and justaposed to said magnetically actuable member for attracting said member into blocking relationship with said cylinder rotation means.

29. An apparatus as in claim 27 further characterized by said bias means comprising a magnetic means oriented in a repelling polarization with and juxtaposed to said magnetically actuable member for repelling said member into blocking relationship with said cylinder rotation means.

30. An apparatus as in claim 27 further characterized by said cylinder rotation means comprising a linkage mechanically coupled between said trigger and said cylinder and said linkage having a notch formed therein and said magnetically actuable member having an extension thereof for engaging said notch.

31. An apparatus as in claim 27 further characterized by said cylinder having a plurality of projections on one end thereof, and said projections forming a portion of said cylinder rotation means, and said magnetically actuable member being slideably disposed for interfering with said projections.

32. In a safety apparatus for preventing the unauthorized firing of a weapon having a trigger, a cylinder for holding cartridges to be fired by said weapon, a cylinder rotation means operative in response to movement of said trigger, a hammer, and a hammer movement means operative in response to movement of said trigger, wherein the invention comprises:

a magnetically actuable member slideably mounted with respect to a plurality of notches formed in one end of said cylinder, said member having at least one magnetically polarized end;

stop means for preventing said member from sliding beyond a preferred distance;

bias means juxtaposed said magnetically actuable member for maintaining said member in a position for engaging said notches for preventing rotation of said cylinder thereby preventing firing of said weapon; and a magnetic ring for wearing on a finger of a hand gripping said weapon, said ring being operative on said polarized end for overcoming said bias means, so as to slide said member out of the position for engaging said notches when said ring is being worn on a finger of the weapon gripping hand.

33. An apparatus as in claim 32 further characterized by said bias means comprising a magnetic means oriented in an attracting polarization with and juxtaposed to said magnetically actuable member for attracting said member into a position for engaging said notches.

34. A safety apparatus for inhibiting movement of a trigger for preventing unauthorized firing of a weapon having a trigger and a trigger protector with a notch formed therein, comprising:

a nonferruginous retaining means for mounting on the rear of the trigger;

a magnetically actuable member slideably mounted with respect to said trigger protector and said trigger, with said member having a restrictor responsive to the position of said member;

stop means for preventing said member from sliding beyond a preferred distance;

bias means juxtaposed said magnetically actuable member for maintaining said restrictor of said member in a blocking relationship with an unnotched portion of said trigger protector preventing the trigger firing said weapon; and a magnetic ring for wearing on a finger of a hand gripping said weapon, said ring being operative for overcoming said bias means, so as to slide said restrictor out of the blocking relationship with said unnotched portion so that said restrictor engages said notch when said ring is being worn on a finger of the weapon gripping hand.

35. An apparatus as in claim 34 further characterized by said bias means comprising a magnetic means oriented in an attracting polarization with and juxtaposed to said magnetically actuable member for attracting said restrictor of said member into blocking relationship with said unnotched portion of said trigger protector.

36. An apparatus as in claim 34 further characterized by said bias means comprising a magnetic means oriented in a repelling polarization with and juxtaposed to said magnetically actuable member for repelling said restrictor of said member into blocking relationship with said unnotched portion of said trigger protector.

37. A safety apparatus for preventing unauthorized firing of a weapon having a handle, and a trigger with a projection on the side of the trigger opposite the side normally engaged by the finger of the user of the weapon; comprising:

a magnetically actuable member slideably mounted with respect to said trigger, said member mounted about the handle of said weapon in facing relationship with said opposite side of said trigger and said member having a restrictor extension;

stop means for preventing said member from sliding beyond a preferred distance;

bias means juxtaposed said magnetically actuable member for maintaining said restrictor extension in confronting relation with said projection of said trigger for preventing the trigger firing said weapon; and a magnetic ring for wearing on a finger of a hand gripping said weapon, said ring being operative to overcome said bias means so as to slide said restrictor out of blocking relationship with said projection of said trigger thereby permitting said trigger to fire said weapon when said ring is being worn on a finger of the weapon gripping hand.

* * * * *